US009824639B2

(12) United States Patent
Nagashima

(10) Patent No.: US 9,824,639 B2
(45) Date of Patent: Nov. 21, 2017

(54) IMAGE DISPLAY APPARATUS AND CONTROL METHOD THEREOF

(71) Applicant: CANON KABUSHIKI KAISHA, Tokyo (JP)

(72) Inventor: Yoshiyuki Nagashima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 327 days.

(21) Appl. No.: 14/270,072

(22) Filed: May 5, 2014

(65) Prior Publication Data

US 2014/0333593 A1 Nov. 13, 2014

(30) Foreign Application Priority Data

May 10, 2013 (JP) ..... 2013-100421
Apr. 11, 2014 (JP) ..... 2014-081773

(51) Int. Cl.
*G09G 3/34* (2006.01)

(52) U.S. Cl.
CPC ..... *G09G 3/3426* (2013.01); *G09G 2320/045* (2013.01); *G09G 2320/0686* (2013.01); *G09G 2320/0693* (2013.01); *G09G 2360/145* (2013.01); *G09G 2360/16* (2013.01)

(58) Field of Classification Search
CPC .. G09G 3/36; G09G 3/3426; G09G 2320/045; G09G 2360/16; G09G 2320/0693; G09G 2360/145; G09G 2320/0686
USPC ..... 345/207, 690, 697, 698
See application file for complete search history.

(56) References Cited

U.S. PATENT DOCUMENTS

2001/0033399 A1* 10/2001 Kashioka ..... H04N 1/40012 358/518
2002/0090213 A1* 7/2002 Ohtsuka ..... G03B 7/28 396/234
2003/0234785 A1* 12/2003 Matsuda ..... H04N 5/74 345/426
2004/0140982 A1* 7/2004 Pate ..... H04N 9/3182 345/600
2005/0248594 A1* 11/2005 Usui ..... G09G 3/2007 345/690
2006/0181552 A1* 8/2006 Hopple ..... G09G 3/20 345/690

(Continued)

FOREIGN PATENT DOCUMENTS

JP 2007-034209 A 2/2007

*Primary Examiner* — Amare Mengistu
*Assistant Examiner* — Gloryvid Figueroa-Gibson
(74) *Attorney, Agent, or Firm* — Cowan, Liebowitz & Latman, P.C.

(57) ABSTRACT

An image display apparatus includes: a plurality of light emitting units; a display panel; a first acquisition unit configured to acquire brightness information, a first control unit configured to determine light emission quantity for each of the light emitting units; a second acquisition unit configured to acquire a detected value of light from a predetermined region; a first determination unit configured to determine whether a change due to a difference of the light emission quantity between the light emitting units is generated in the light from the predetermined region; a calibration unit configured to perform calibration of display characteristics; and a second control unit configured to control the calibration on the basis of a determination result of the first determination unit.

10 Claims, 12 Drawing Sheets

(56) References Cited

U.S. PATENT DOCUMENTS

| | | | | |
|---|---|---|---|---|
| 2008/0297464 | A1* | 12/2008 | Ito | G09G 3/3426 345/102 |
| 2010/0002026 | A1* | 1/2010 | Seetzen | G09G 3/3426 345/690 |
| 2015/0044784 | A1* | 2/2015 | Suzuki | H01L 51/5215 438/7 |

* cited by examiner

IMAGE DISPLAY APPARATUS AND CONTROL METHOD THEREOF

BACKGROUND OF THE INVENTION

Field of the Invention

The present invention relates to an image display apparatus and a control method thereof.

Description of the Related Art

Lately the image quality of liquid crystal displays is becoming progressively advanced, and the level of user' demands for stability in display devices and gradation of display images (images displayed on a screen (display surface)) is escalating daily.

However the display characteristics of liquid crystal displays change due to age related deterioration, and this change of display characteristics changes the gradation of display images. Therefore in order to display images that always have stable gradation, it is necessary to periodically calibrate the display characteristics. Particularly in the case of medical display devices used for diagnosis, such a change in the gradation of images could affect diagnosis, so insuring the stable gradation of images is a critical issue.

One calibration method is using an optical sensor that detects light from a part of a region of the screen (Japanese Patent Application Laid-Open No. 2007-34209). In concrete terms, calibration is performed using detected values by the optical sensor acquired when an image for calibration is displayed on this part of the region. According to the technique disclosed in Japanese Patent Application Laid-Open No. 2007-34209, the optical sensor can be housed in a bezel part, and placed in a position facing the screen only when calibration is executed. Therefore the optical sensor never obstructs a part of the screen except when executing calibration. In other words, the optical sensor never interrupts the visibility of a displayed image.

Light emitting diodes (LEDs), which have a long life span and low power consumption, lately are used as the light source of the backlight of liquid crystal displays.

Further, a known control method entails a backlight constituted by a plurality of light emitting units each of which has one or more LEDs, and increasing the contrast of the display images by individually controlling the light emission quantity (light emission intensity) of the plurality of light emitting units in accordance with the brightness information (e.g. statistical amount of brightness) of the input image data. This control is normally called "local dimming control". In local dimming control, the light emission quantity of the light emitting units corresponding to a bright region is set to a high value, and the light emission quantity of the light emitting units corresponding to a dark region is set to a low value, whereby the contrast of the display image is enhanced.

However if the calibration is executed during local dimming control, the light from the part of the region (region that emits light to be detected by the optical sensor) changes due to the difference of the light emission quantity between the light emitting units, and error in the detected value by the optical sensor sometimes increases. This may result in the inability to perform accurate calibration. Details on this will now be described.

It is known that in local dimming control, the contrast of display images can be enhanced, but this causes a halo phenomenon to occur.

FIG. 14 shows an example of an input image 1401, a display image 1402 and a backlight emission pattern 1403.

If the input image 1401 (image of a white object on black background) is inputted, the light emission quantity of light emitting units (LED_Bk) corresponding to the region where the black background is displayed, out of the screen region, is set to a low value due to local dimming control. Then the light emission quantity of light emitting units (LED_W) corresponding to the region where a white object is displayed is set to a high value. Thereby the contrast of the display image can be enhanced.

However, because the difference of the light emission quantity between LED_Bk and LED_W is large, light from LED_W is leaked into a region corresponding to LED_Bk, and a halo phenomenon is generated in the region A of the display image. The halo phenomenon is a phenomenon where a dark region around a bright region is brightly displayed, and in the case of FIG. 14, due to the halo phenomenon, a black brightness in the black background is displayed at a higher level. In other words, the light from the region A is changed by the light from the light emitting units corresponding to the peripheral region.

In the case of FIG. 14, the light from a region including a part of the region A where the halo phenomenon is generated is detected by the optical sensor, which increases error in the detected value determined by the optical sensor, and makes it difficult to perform accurate calibration.

SUMMARY OF THE INVENTION

The present invention provides a technique to accurately calibrate the display characteristics in an image display apparatus that performs local dimming control.

The present invention in its first aspect provides an image display apparatus that can execute calibration of display characteristics, comprising:

a plurality of light emitting units corresponding to a plurality of divided regions constituting a region of a screen;

a display panel configured to display an image on the screen by transmitting light from the plurality of light emitting units at a transmittance based on input image data;

a first acquisition unit configured to acquire brightness information of the input image data for each divided region;

a first control unit configured to determine light emission quantity for each of the light emitting units on the basis of the brightness information of each divided region acquired by the first acquisition unit, and to allow each light emitting unit to emit light at the determined light emission quantity;

a second acquisition unit configured to acquire, from a sensor, a detected value of light from a predetermined region of the screen;

a first determination unit configured to determine whether a change due to a difference of the light emission quantity between the light emitting units is generated in the light from the predetermined region, on the basis of the light emission quantity of each light emitting unit determined by the first control unit;

a calibration unit configured to perform the calibration using the detected value from the sensor; and a second control unit configured to control at least one of the sensor, the second acquisition unit and the calibration unit, so that the calibration, directly using the detected value acquired when the first determination unit has determined that the change is generated, is not performed.

The present invention in its second aspect provides a control method of an image display apparatus that can execute calibration of display characteristics, the image display apparatus including:

a plurality of light emitting units corresponding to a plurality of divided regions constituting a region of a screen; and a display panel configured to display an image on the screen by transmitting light from the plurality of light emitting units at a transmittance based on input image data, and the control method of the image display apparatus comprising:

a first acquisition step of acquiring brightness information of the input image data for each divided region;

a first control step of determining light emission quantity for each of the light emitting units on the basis of the brightness information of each divided region acquired in the first acquisition step, and allowing each light emitting unit to emit light at a predetermined light emission quantity;

a second acquisition step of acquiring, from a sensor, a detected value of light from a predetermined region of the screen;

a first determination step of determining whether a change due to a difference of the light emission quantity between the light emitting units is generated in the light from the predetermined region, on the basis of the light emission quantity of each light emitting unit determined in the first control step;

a calibration step of performing the calibration using the detected value from the sensor; and a second control step of controlling at least one of the sensor, the second acquisition step and the calibration step, so that the calibration, directly using the detected value acquired when it is determined that the change is generated in the first determination step, is not performed.

According to this invention, the display characteristics can be accurately calibrated in an image display apparatus that performs local dimming control.

Further features of the present invention will become apparent from the following description of exemplary embodiments with reference to the attached drawings.

DESCRIPTION OF THE EMBODIMENTS

Embodiment 1

An image display apparatus and a control method thereof according to Embodiment 1 of the present invention will now be described with reference to the drawings. The image display apparatus according to this embodiment is an image display apparatus that can execute calibration of display characteristics. The calibration is performed using detected values by an optical sensor. The optical sensor detects light from a predetermined region of a screen. The image display apparatus according to this embodiment displays images on a screen by transmitting light from a plurality of light emitting units corresponding to a plurality of divided regions constituting a region of the screen. Further, the image display apparatus according to this embodiment is an image display apparatus that can execute local dimming control for controlling the light emission quantity (light emission intensity) of each light emitting unit. The image display apparatus according to this embodiment can accurately calibrate the display characteristics even when executing the local dimming control.

Figure 1:
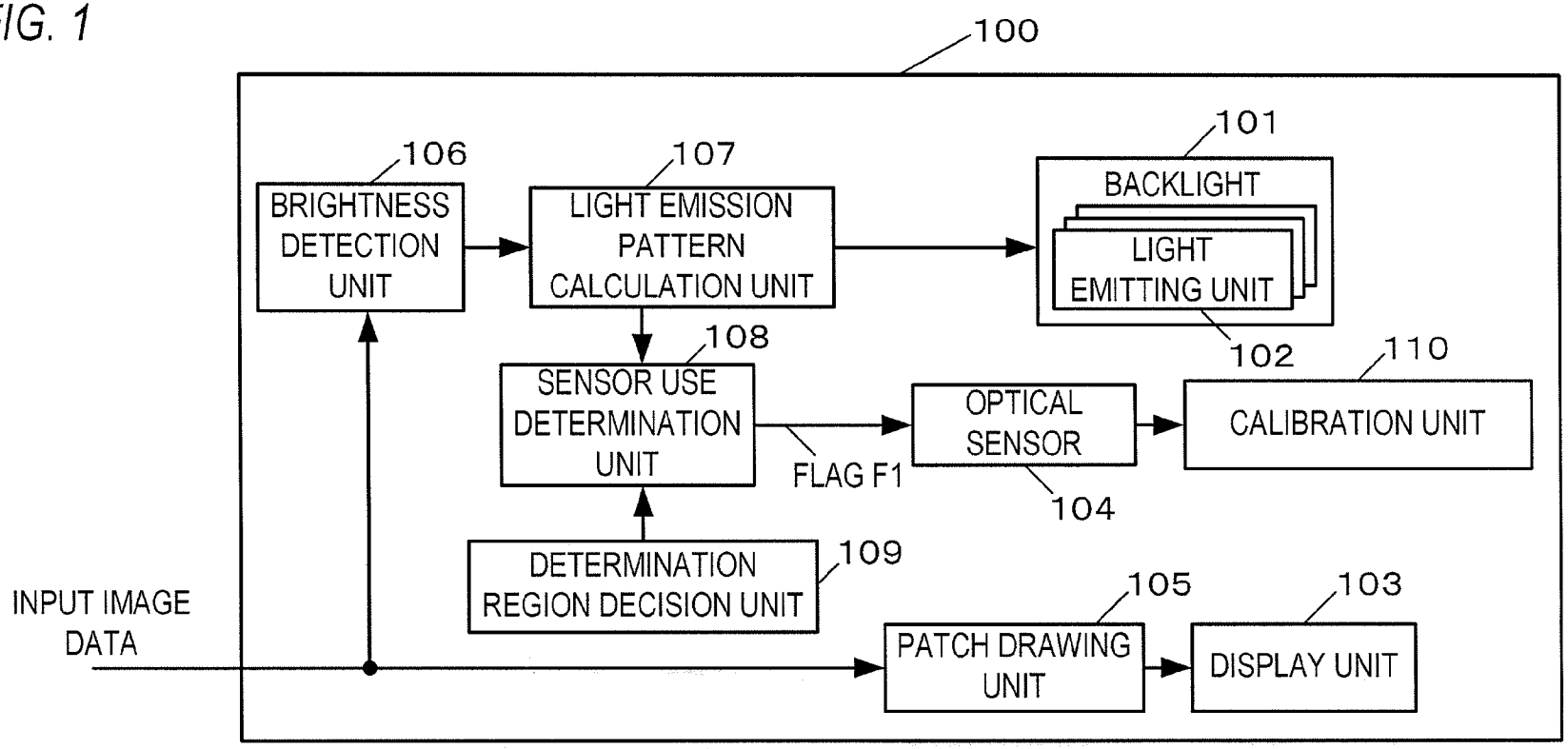
FIG. 1 is a block diagram depicting an example of a functional configuration of an image display apparatus according to Embodiment 1.

FIG. 1 is a block diagram depicting an example of a functional configuration of the image di splay apparatus 100 according to this embodiment.

As shown in FIG. 1, the image display apparatus 100 includes a backlight 101, a display unit 103, an optical sensor 104, a patch drawing unit 105, a brightness detection unit 106, a light emission pattern calculation unit 107, a sensor use determination unit 108, a determination region decision unit 109 and a calibration unit 110.

The backlight 101 includes a plurality of light emitting units 102 corresponding to a plurality of divided regions constituting the region of the screen. Each light emitting unit 102 has one or more light sources. For the light source, a light emitting diode (LED), a cold cathode tube, an organic EL or the like can be used.

The display unit 103 is a display panel that displays an image on the screen by transmitting light from the backlight 101 (plurality of light emitting units 102) at a transmittance based on input image data. For example, the display unit 103 is a liquid crystal panel having a plurality of liquid crystal elements of which transmittance is controlled based on input image data. The display unit 103 is not limited to a liquid crystal panel. For example, the display elements of the display unit 103 are not limited to liquid crystal elements and can be any element (s) that can control the transmittance.

The optical sensor 104 detects light from a predetermined region (a part of the region of the screen: photometric region).

The patch drawing unit 105 generates display image data by correcting the input image data so that a calibration image is displayed in the photometric region, and an image in accordance with the input image data (input image) is displayed in the remaining region of the screen. In this embodiment, the calibration image is a patch image, and data of the patch image (patch image data) is stored in advance. The patch drawing unit 105 generates the display image data by combining the patch image data with the input image data so that the patch image is displayed in the photometric region, and the input image is displayed in the remaining region. The display image data is outputted to the display unit 103. In the display unit 103, the light from the backlight 101 is transmitted at a transmittance based on the display image data, and the image is displayed on the screen. The calibration image can be any image, and is not limited to a patch image. The input image data may be used as display image data, and in this case the patch drawing unit 105 is unnecessary.

The brightness detection unit 106 acquires (detects) brightness information of input image data for each divided region. The brightness information is brightness (luminance) statistics, for example, and in concrete terms includes a maximum brightness value, a minimum brightness value, an average brightness value, a modal brightness value, an intermediate brightness value and a brightness histogram. In this embodiment, it is assumed that the brightness information is detected from the input image data, but the brightness information may be acquired from an another source. For example, if the brightness information is added to the input image data as metadata, this brightness information can be extracted.

The light emission pattern calculation unit 107 determines the light emission quantity for each light emitting unit, based on the brightness information of each divided region acquired by the brightness detection unit 106, and allows each light emitting unit to emit light at the light emission quantity determined above (first control processing: light emission control processing). In this embodiment, it is assumed that the light emission quantity of the light emitting unit 102 is determined for each light emitting unit 102, based on the brightness information of the divided region corresponding to the light emitting unit 102, but the method of determining the light emission quantity is not limited to this. For example, the light emission quantity of one light emitting unit 102 may be determined using the brightness information of a plurality of divided regions (e.g. brightness information on the corresponding divided region, and peripheral divided regions thereof).

The sensor use determination unit 108 determines whether a change is generated in the light from the photometric region due to the difference of the light emission quantity between the light emitting units, on the basis of the light emission quantity of each light emitting unit 102 determined by the light emission pattern calculation unit 107 (first determination processing: change determination processing). In concrete terms, it is determined whether this change is generated in the light from the photometric region, on the basis of the light emission quantity corresponding to the divided regions located in a predetermined range from the photometric region. Then the sensor use determination unit 108 controls the optical sensor 104 so that the light is not detected when it is determined that change is generated in the change determination processing (second control processing: sensor control processing). The change determination processing and the sensor control processing may be performed by mutually different functional units.

The determination region decision unit 109 decides the target divided regions of the change determination processing (divided region corresponding to the light emitting units where the light emission intensity is used in the change determination processing). In this embodiment, the determination region decision unit 109 decides the divided regions located in a predetermined range from the photometric region as the target divided regions of the change determination processing. The sensor use determination unit 108 acquires the divided region decision result from the determination region decision unit 109, and performs the change determination processing using the light emission quantity according to the acquired decision result. The determination region decision unit 109 may determine the light emitting units corresponding to the target divided regions of the change determination processing. If the target divided regions of the change determination processing are determined in advance (e.g. if the position of the optical sensor 104 (that is, a photometric region) cannot be changed), the image display apparatus 100 need not include the determination region decision unit 109.

The calibration unit 110 acquires a detected value from the optical sensor 104 (second acquisition processing), and calibrates the display characteristics using the detected value determined by the optical sensor 104. In this embodiment however, the optical sensor 104 is controlled not to detect light when it is determined that a change is generated in the change determination processing. Therefore the calibration unit 110 performs the calibration without using the detected value acquired when it is determined that a change is generated in the change determination processing. In this embodiment, it is assumed that the optical sensor 104 is controlled not to detect light when it is determined that a change is generated in the change determination processing, but this control is not always required. In other words, the optical sensor 104 may constantly (or periodically) detect light. The image display apparatus may include a control unit to control the calibration unit 110, so that the detected value, acquired when it is determined that a change is generated in the change determination processing, is not received from the sensor. The image display apparatus may have a control unit to control the calibration unit 110, so that the calibration is performed without using a detected value acquired when it is determined that a change is generated in the change determination processing. The image display apparatus may include a control unit to control the calibration unit 110, so that the calibration force-quits when it is determined that a change is generated in the change determination processing. Control of at least one of the detection of light, the acquisition of the detected value, the use of the detected value and the execution of the calibration is required so that the calibration, directly using a detected light acquired when it is determined that a change is generated in the change determination processing, is not performed. Processing to acquire a detected value from the optical sensor and calibration may be performed by mutually different functional units.

A concrete example of a configuration of the backlight 101 will be described.

Figure 2:
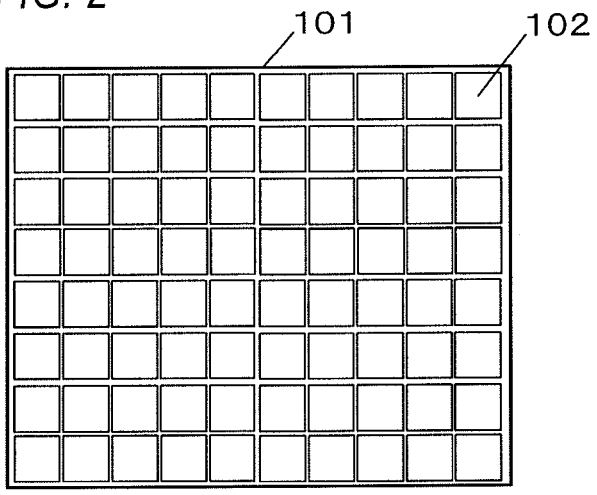
FIG. 2 shows an example of a configuration of a backlight according to Embodiment 1.

FIG. 2 shows an example of a configuration of the backlight 101. In the example in FIG. 2, a region of the screen is divided into 10 horizontal×8 vertical regions=80 regions, which means that the backlight 101 has 80 light emitting units 102, corresponding to 80 divided regions (10 horizontal×8 vertical=80 light emitting units 102). The number of the divided regions (and the light emitting units) may be more or less than 80. For example, 1 horizontal×20 vertical regions=20 divided regions may be set. The number of the divided regions is arbitrary, and an appropriate number of divided regions can be set according to the intended use, for example.

A concrete example of a relationship between a position of the optical sensor 104 and a display position of a patch image will be described.

Figure 3:
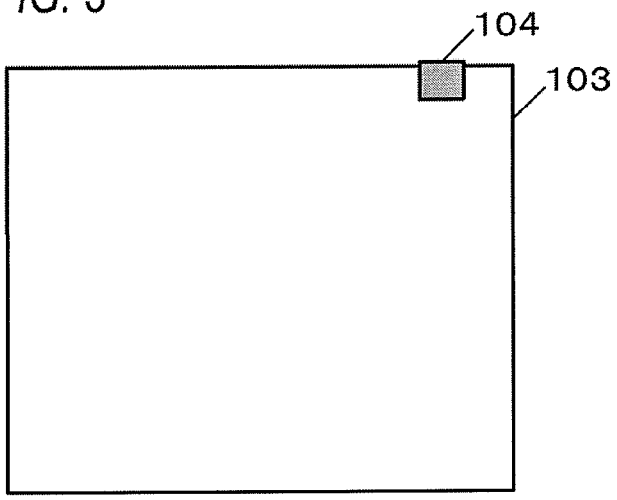
FIG. 3 shows an example of a position of an optical sensor according to Embodiment 1.

FIG. 3 shows an example of the position of the optical sensor 104. In the case of FIG. 3, the optical sensor 104 is disposed on the screen, so that the detection surface faces the photometric region.

Figure 4:
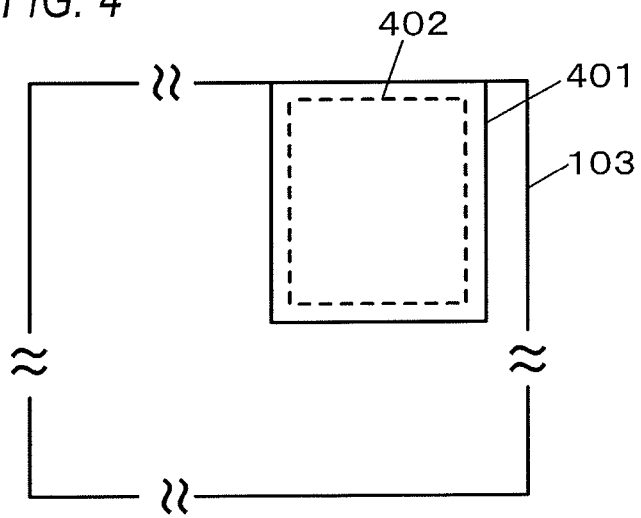
FIG. 4 shows an example of a positional relationship of the optical sensor and a patch image according to Embodiment 1.

FIG. 4 shows an example of a positional relationship between a position of the optical sensor 104 and a display position of a patch image. A region 401 indicated by a solid line in FIG. 4 is a region where the optical sensor 104 is disposed. A region 402 indicated by a broken line in FIG. 4 is a display region of the patch image, that is, a photometric region (region from which light detected by an optical sensor is emitted). Therefore the patch image is displayed on the photometric region (input image data is di splayed on the remaining region). In the example shown in FIG. 4, the display region of the patch image is the same as the photometric region, but the display region of the patch image may be larger than the photometric region.

The optical sensor 104 detects the light from the photometric region (to be more specific, the brightness and color of the patch image), only when the sensor use determination unit 108 determines that the change is not generated in the change determination processing.

A concrete example of the processing by the light emission pattern calculation unit 107 will be described. Here a case of acquiring an average brightness value (average picture level (APL)) as the brightness information will be described.

For example, the light emission pattern calculation unit 107 determines a divided region of which the acquired APL is low as a "divided region corresponding to a portion of which brightness of the input image data is low", and performs the processing allowing a light emitting unit 102, corresponding to this divided region, to emit light at a low light emission quantity. The light emission pattern calculation unit 107 determines a divided region of which the acquired APL is high as a "divided region corresponding to a portion of which brightness of the input image data is high", and performs processing to allow a light emitting unit 102, corresponding to this divided region, to emit light at a high light emission quantity. Thereby the contrast of the image displayed on the display unit 103 can be enhanced. This processing is often used in conventional local dimming control, therefore detailed description thereof (e.g. detailed description on the determination method for the light emission quantity) is omitted. The processing by the light emission pattern calculation unit 107 is not limited to a processing to control the light emission quantity based on an APL, but the processing performed in conventional local dimming control may be applied to the processing performed by the light emission pattern calculation unit 107.

Figure 5:
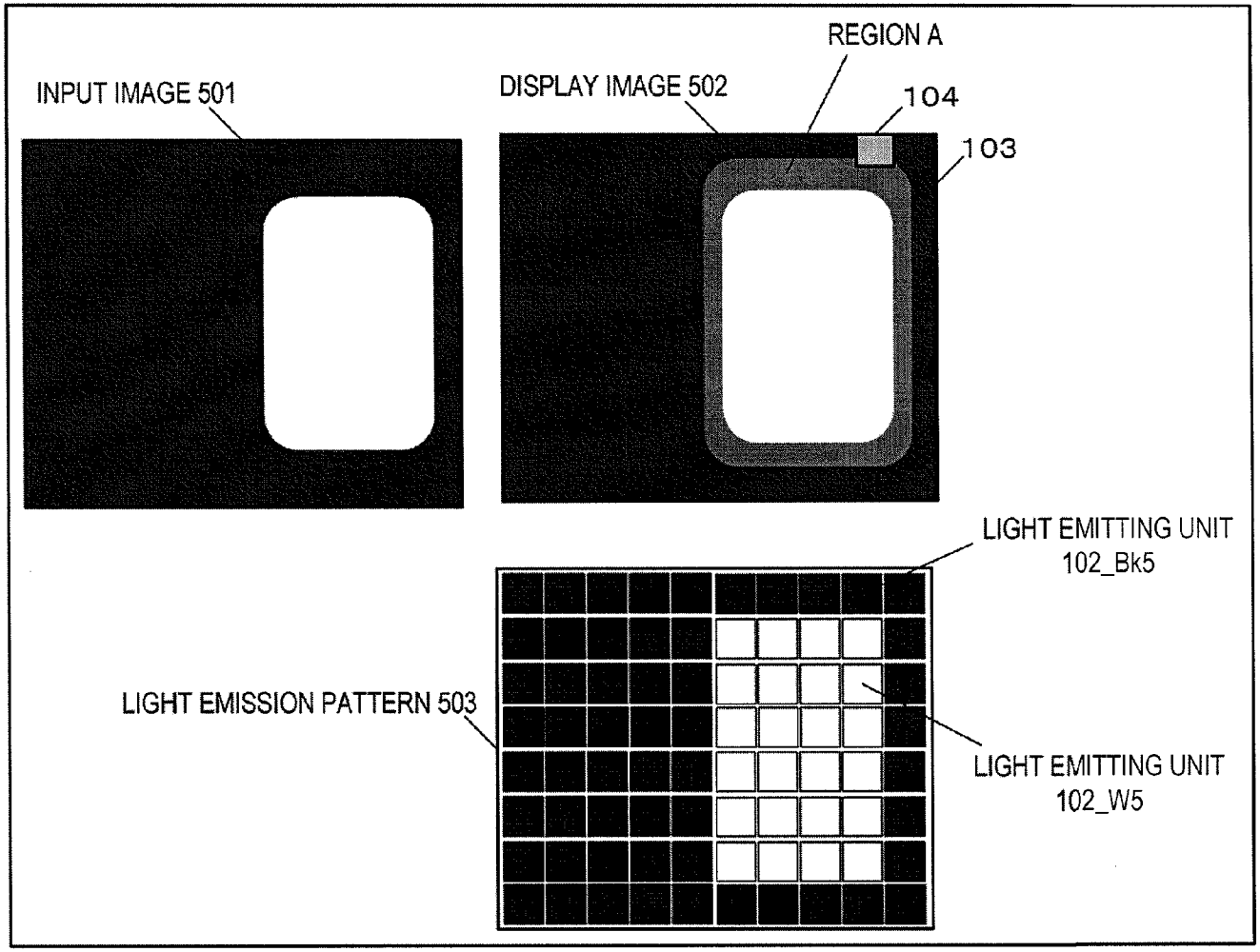
FIG. 5 is an illustration explaining a halo phenomenon according to Embodiment 1.
Figure 6:
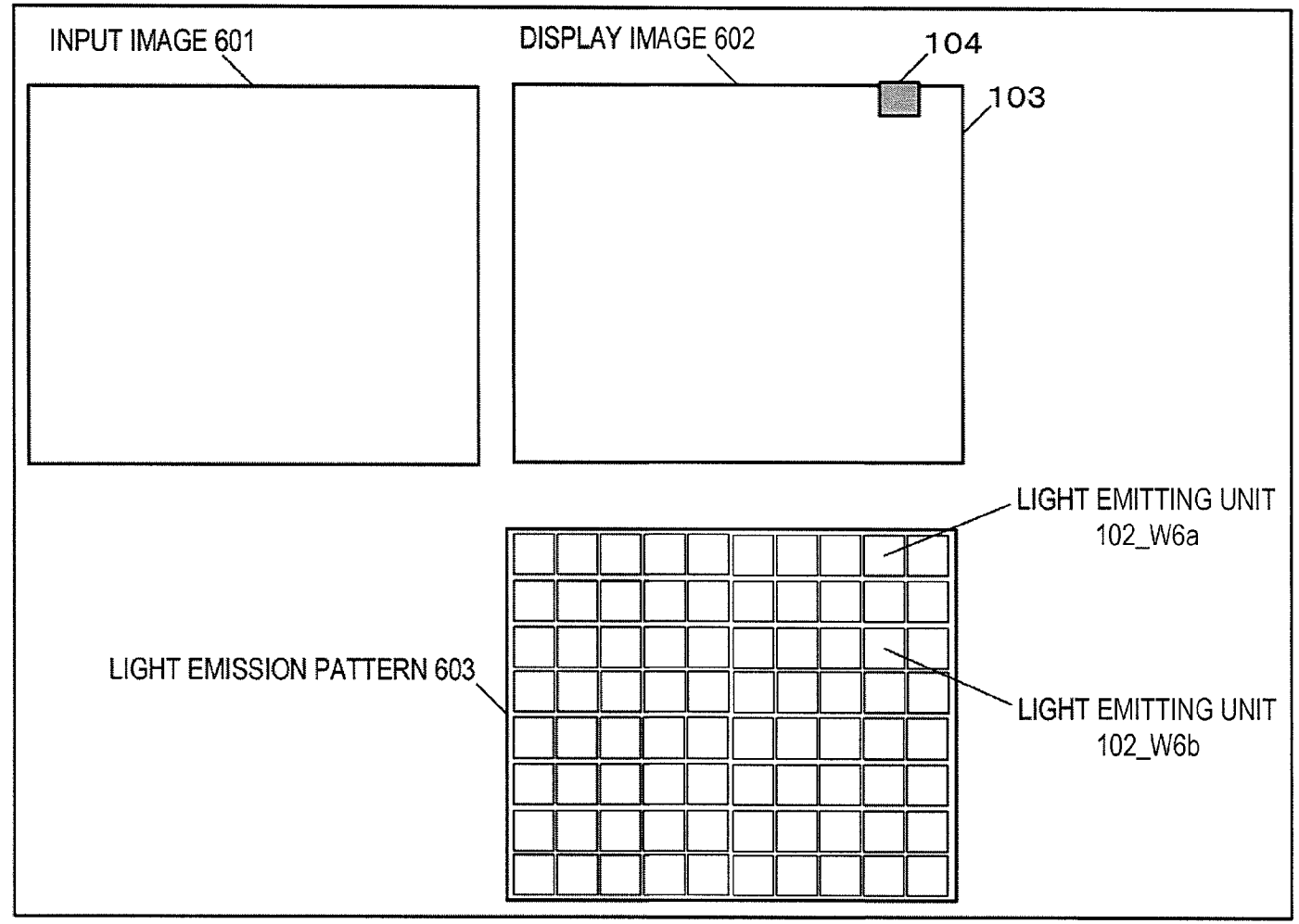
FIG. 6 is an illustration explaining a halo phenomenon according to Embodiment 1.

If the above mentioned local dimming control is performed, the change may be generated in the display brightness and display colors (brightness and color on screen) due to the difference of the light emission quantity between the light emitting units. This phenomenon is called the "halo phenomenon", and conspicuously appears when the difference of the light emission quantity between the light emitting units is large. The generation of the halo phenomenon due to the local dimming control will be described with reference to FIG. 5 and FIG. 6. FIG. 5 is an example when the conspicuous halo phenomenon appears, and FIG. 6 is an example when the conspicuous halo phenomenon does not appear. The reference numeral 501 in FIG. 5 and the reference numeral 601 in FIG. 6 denote an input image (an image represented by the input image data). The reference numeral 502 in FIG. 5 and the reference numeral 602 in FIG. 6 denote a display image (an image displayed on screen). The reference numeral 503 in FIG. 5 and the reference numeral 603 in FIG. 6 denote a light emission pattern of the backlight 101 (a light emission quantity of each light emitting unit 102).

An example of the case when the conspicuous halo phenomenon appears will be described first with reference to FIG. 5.

The input image 501 is an image where a white object exists in a black background, and an APL is low in a divided region that mostly includes the black background region, and an APL is high in a divided region that mostly includes the white object region.

As mentioned above, the light emission pattern calculation unit 107 performs a processing to allow a light emitting unit 102, corresponding to a divided region of which the acquired APL is low, to emit light at a low light emission quantity, and a light emitting unit 102, corresponding to a divided region of which the acquired APL is high, to emit light at a high light emission quantity. Therefore as the light emission pattern 503 in FIG. 5 shows, the light emission pattern calculation unit 107 performs processing to allow a light emitting unit 102_Bk5, corresponding to a divided region which mostly includes the black background region, to emit light at a low light emission quantity, and to allow a light emitting unit 102_W5, corresponding to a divided region which mostly includes the white objects region, to emit light at a high light emission quantity.

By this processing, the contrast of the display image can be enhanced.

However the difference of the light emission quantity between the light emitting unit 102_Bk5 and the light emitting unit 102_W5 (a light emitting unit corresponding to the second divided region downward from the divided region corresponding to the light emitting unit 102_Bk5) is large. Therefore the light from the light emitting unit 102_W5 leaks into the divided region corresponding to the light emitting unit 102_Bk5, and the halo phenomenon is generated in the region A in the display image 502. In other words, the light from the region A (brightness and colors of the region A) changes due to the light from the light emitting units corresponding to the peripheral region. In concrete terms, the region A in the black background region is displayed brighter than the remainder of the black background region.

Furthermore, in the case of the halo phenomenon generated in the photometric region, as shown in FIG. 5, the optical sensor 104 detects light that is changed by the halo phenomenon (light in a state where black floaters or the like are generated). In other words, if the halo phenomenon is generated in the photometric region, error in the detected value by the optical sensor increases. The use of such a detected value makes it impossible to perform accurate calibration.

An example of the case when the conspicuous halo phenomenon does not appear will be described next with reference to FIG. 6.

The input image 601 is an image that is entirely white, and the APL is high in each divided region. Therefore as the light emission pattern 603 in FIG. 6 shows, the light emission pattern calculation unit 107 performs processing to allow each light emitting unit to emit light at a high light emission quantity. As a result, a display image 602, where brightness within the screen is uniform, is displayed.

In this case, the difference of the light emission quantity between the light emitting units, such as the light emitting unit 102_W6*a* and the light emitting unit 102_W6*b* (a light emitting unit corresponding to the second divided region downward from the divided region corresponding to the light emitting unit 102_W6*a*), is small. Therefore the conspicuous halo phenomenon does not appear. In the case of FIG. 6, the difference of the light emission quantity between the light emitting units is zero, hence a halo phenomenon is not generated. Needless to say, a halo phenomenon is not generated in the photometric region either. In such a case, the optical sensor can acquire a detected value with a small degree of error, and accurate calibration can be performed.

Therefore in this embodiment, the detected values acquired when a conspicuous halo phenomenon is generated in the photometric region are not used for the calibration, but only the detected values acquired when a conspicuous halo phenomenon is not generated in the photometric region are used for the calibration. As a result, the display characteristics can be accurately calibrated in an image display apparatus that performs the local dimming control. In concrete terms, the optical sensor 104 is controlled so that light is not detected when a conspicuous halo phenomenon is generated in the photometric region, but light is detected only when a conspicuous halo phenomenon is not generated in the photometric region. Thereby only detected values with a small degree of error can be acquired, and accurate calibration can be performed.

This control of the optical sensor 104 is implemented by the sensor use determination unit 108 and the determination region decision unit 109, as described above. A concrete example of the processings by the sensor use determination unit 108 and the determination region decision unit 109 will be described with reference to FIG. 7.

Figure 7:
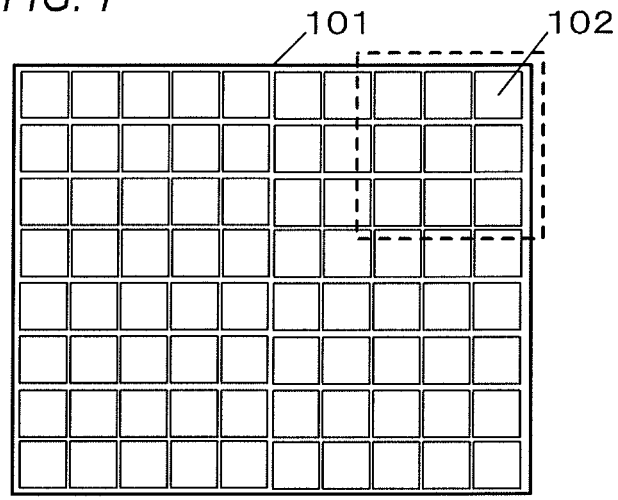
FIG. 7 is an illustration explaining a determination region decision unit according to Embodiment 1.

As mentioned above, the determination region decision unit 109 decides (selects) the divided regions located in a predetermined range from the photometric region as the target divided regions of the change determination processing. If the distance from the light emitting unit to the photometric region is short, more light leaks from the light emitting unit into the photometric region, and a conspicuous halo phenomenon is more likely to be generated in the photometric region by such light. If the distance from the light emitting unit to the photometric region is long, on the other hand, less light leaks from the light emitting unit into the photometric region, and a conspicuous halo phenomenon is less likely to be generated in the photometric region. Therefore according to this embodiment, the photometric region and the peripheral divided regions are selected as the target divided regions of the change determination processing. In concrete terms, the divided regions, including the photometric region, are selected as the target divided regions of the change determination processing. As indicated by the broken line in FIG. 7, one divided region in the horizontal direction, and two divided regions in the vertical direction are selected from the divided regions, including the photometric region, are selected as the target divided regions of the change determination processing. The broken line in FIG. 7 shows the light emitting units 102 corresponding to the divided regions decided (selected) by the determination region decision unit 109. FIG. 7 is a case when the divided region, which is located in the second region from the right and the first region from the top, includes the photometric region. In other words, in the example in FIG. 7, 3 horizontal×3 vertical=9 divided regions are selected.

The method of selecting the target divided regions of the change determination processing is not limited to the method described above. For sample, the divided region, including the photometric region and the divided regions adjacent to this divided region, may be selected as the target divided regions of the change determination processing. In other words, the size of one divided region may be regarded as the size of the predetermined range. As the above mentioned method, the size of the predetermined range may be different between the horizontal direction and the vertical direction.

The divided region, including the photometric region, may be a divided region that at least partially includes the photometric region, or may be a divided region where a ratio of the size of the photometric region, included in this divided region, with respect to the size of this divided region, is a predetermined ratio or more.

The sensor use determination unit 108 calculates a first determination value Lum_Diff. The first determination value is a ratio of a difference, which is acquired by subtracting a minimum value L_min from a maximum value L_max of the light emission quantity of light emitting units corresponding to a divided region decided (selected) by the determination region decision unit 109, with respect to the maximum value L_max. In the case of FIG. 7, the ratio of the difference value, which is acquired by subtracting a minimum value L_min from a maximum value L_max of the light emission quantity of the 9 light emitting units indicated by the broken line, with respect to the maximum value L_max, is calculated as the first determination value Lum_Diff. Then the sensor use determination unit 108 compares the first determination value Lum_Diff with a threshold L_Th. In concrete terms, the sensor use determination unit 108 determines whether the first determination value Lum_Diff is the threshold L_Th or less using Expression 1. If the first determination value Lum_Diff is greater than the threshold L_Th, the sensor use determination unit 108 determines that the detection of light is impossible (light may not be detected). If the first determination value Lum_Diff is the threshold L_Th or less, th sensor use determination unit 108 determines that the detection of light is possible (light may be detected), and outputs a flag F1 which notifies this determination result to the optical sensor 104. This is because if the first determination value Lum_Diff is greater than the threshold L_Th, a conspicuous halo phenomenon is more likely to be generated in the photometric region, and if the first determination value Lum_Diff is the threshold L_Th or less, a conspicuous halo phenomenon is less likely to be generated in the photometric region.

$$\text{Lum_Diff}=(L_\text{max}-L_\text{min})/L_\text{max}\leq L_\text{Th} \qquad \text{(Expression 1)}$$

The optical sensor 104 detects light from the photometric region (brightness and color of the patch image) only when the flag F1 is received.

The sensor use determination unit 108 may output information to indicate that the detection of light is impossible when the first determination value Lum_Diff is greater than the threshold L_Th, and nothing is output when the first determination value Lum_Diff is the threshold L_Th or less. The sensor use determination unit 108 may output information to indicate that the detection of light is possible when the first determination value Lum_Diff is the threshold L_Th or less, and output information to indicate that the detection of light is impossible when the first determination value Lum_Diff is greater than the threshold L_Th.

The threshold L_Th may be any value. The threshold L_Th is determined based on the accuracy of the calibration and the frequency of acquiring the detected values used for calibration, for example. As the value of the threshold L_Th is smaller, error in the detected value used for calibration can be decreased, and the accuracy of the calibration can be enhanced. As the value of the threshold L_Th is greater, the detected values used for calibration can be more easily acquired. In concrete terms, as the value of th threshold L_This greater, the light detection frequency determined by the optical sensor 104 can be increased.

The threshold L_Th may be a fixed value or a value that can be changed. The threshold L_Th may be set by a user, for example, or may be set based on the type and brightness of the input image data.

As described above, according to this embodiment, calibration is performed without using a detected value from the optical sensor, which is acquired when it is determined that a change is generated in the change determination processing (a conspicuous halo phenomenon is generated in the photometric region). In concrete terms, the optical sensor is controlled so that light is not detected when it is determined that a change is generated in the change determination processing. Therefore a detected value is not acquired from the optical sensor when it is determined that a change is generated in the change determination processing. This means that very accurate calibration can be performed using only the detected values determined by the optical sensor, acquired when it is determined that a change is not generated in the change determination processing (conspicuous halo phenomenon is not generated in the photometric region).

If the image data to be displayed changes during the light detection period by the optical sensor, error in the detected value by the optical sensor increases. Further, if the input image data is moving image data, the image data to be displayed is more likely to change during the light detection period by the optical sensor, compared with the case when the input image data is still image data. Therefore the image display apparatus may further include an image determination unit that performs second determination processing (image determination processing), to determine whether the input image data is moving image data or still image data. Then the calibration unit 110 may be controlled so that calibration is performed without using a detected value acquired when the image determination unit determines that the input image data is moving image data. The calibration unit 110 may be controlled so that the detected value acquired when the image determination unit determines that the input image data is moving image data is not acquired from the sensor. The calibration unit 110 may be controlled so that calibration is not performed when the image determination unit determines that the input image data is moving image data. The sensor use determination unit 108 may control the optical sensor so that light is not detected when the image determination unit determines that the input image data is moving image data. By using any of these configurations, an increase of error in the detection value, due to a change of display image data during the light detection period determined by the optical sensor, can be controlled.

In this embodiment, the configuration where the optical sensor 104 is disposed on the screen, so as to face the photometric region, was described as an example, but the present invention is not limited to this. The optical sensor 104 may be an apparatus separate from the image display apparatus 100. The present invention can also be applied to the case of using a standard external optical sensor for calibration, or a case of disposing an optical sensor in a front bezel of the image display apparatus, and detecting light in an out-of-view region on the screen.

Embodiment 2

An image display apparatus and a control method thereof according to Embodiment 2 of the present invention will now be described with reference to the drawings.

In Embodiment 1, the determination region decision unit 109 decides (selects) the divided regions located in a predetermined range from the photometric region, as the target divided regions of the change determination processing. Then on the basis of the light emission quantity corresponding to the divided regions selected by the determination region decision unit 109, it is determined whether a change due to the difference of the light emission quantity between the light emitting units is generated in the light from the photometric region.

However if a number of light emitting units 102 is few as a result of cost reduction of the image display apparatus, for example, more light is leaked from each light emitting unit 102 into the photometric region, and the halo phenomenon is likely to be generated in the photometric region.

Therefore in this embodiment, an example of determining whether a change is generated in the light from the photometric region, on the basis of the light emission quantity of all the light emitting units 102 determined by the light emission pattern calculation unit 107, will be described.

Figure 8:
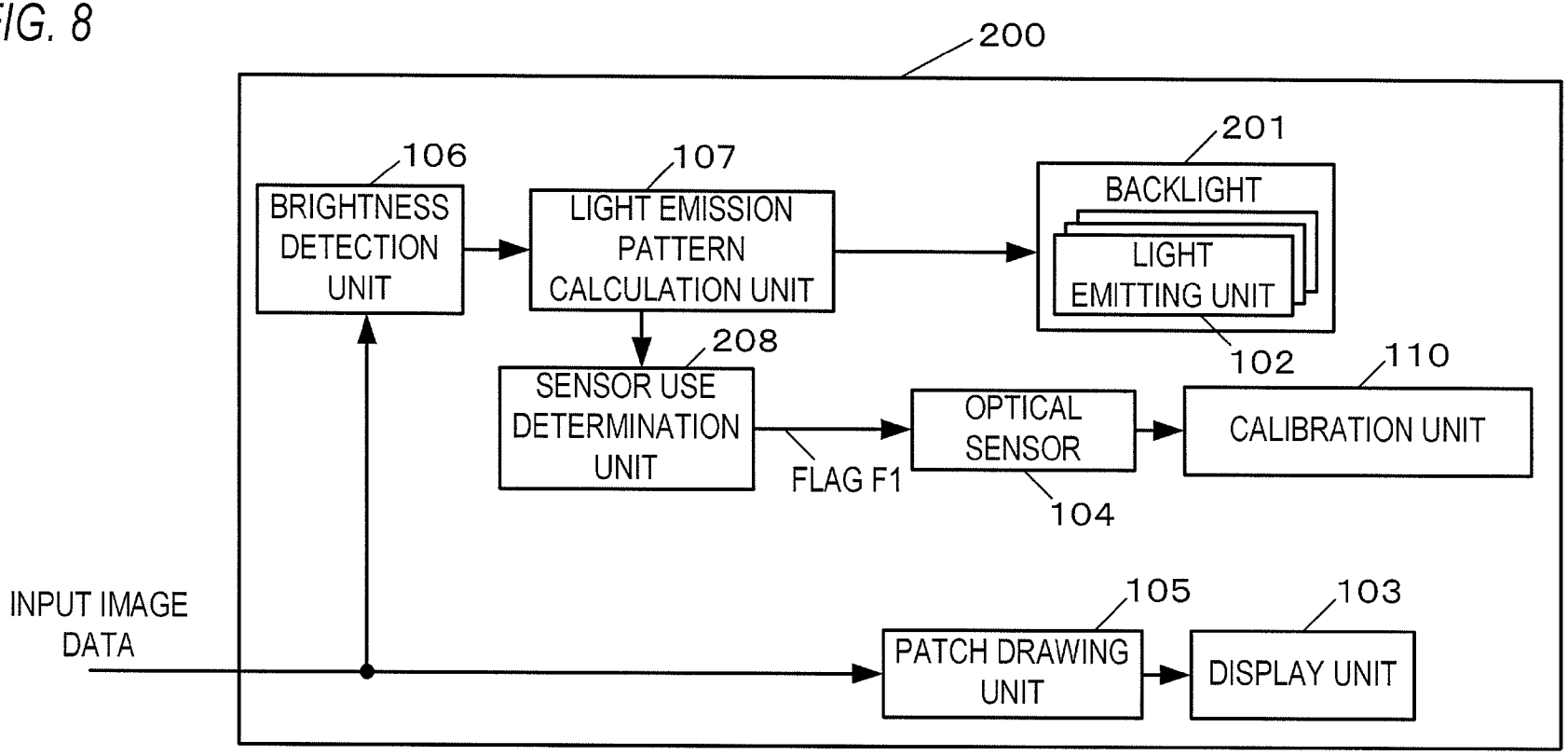
FIG. 8 is a block diagram depicting an example of a functional configuration of an image display apparatus according to Embodiment 2.

FIG. 8 is a block diagram depicting an example of a functional configuration of the image display apparatus 200 according to this embodiment. As shown in FIG. 8, the image display apparatus 200 has a configuration of the image display apparatus 100 according to Embodiment 1, from which the determination region decision unit 109 is removed. A functional unit the same as Embodiment 1 is denoted with a same reference symbol, of which description is omitted.

Figure 9:
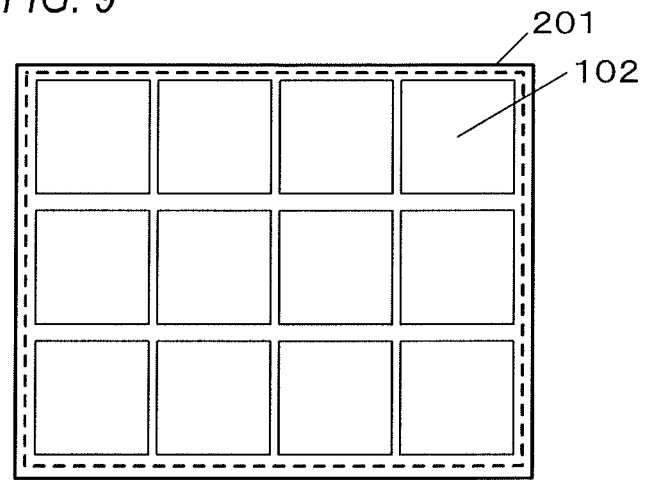
FIG. 9 shows an example of a configuration of a backlight according to Embodiment 2.

In this embodiment, the backlight 201 includes 4 horizontal×3 vertical=12 light emitting units 102, as shown in FIG. 9.

Then the sensor use determination unit 208 determines whether a change is generated in the light from the photometric region on the basis of the light emission quantity of the light emitting units 102 indicated by the broken line in FIG. 9, that is, all the light emitting units 102. In concrete terms, as the first determination value, the ratio of a difference value, which is acquired by subtracting a minimum value from a maximum value of the light emission quantity determined by the light emission pattern calculation unit 107, with respect to the maximum value, is calculated. The other functions are the same as Embodiment 1.

As described above, according to this embodiment, whether a change is generated in the light from the photometric region is determined on the basis of the light emission quantity of all the light emitting units. Thereby whether a change is generated in the light from the photometric region can be accurately determined when a number of light emitting units is few. Therefore very accurate calibration can be performed using only the detected values determined by the optical sensor, acquired when it is determined that a change is not generated in the light from the photometric region (a conspicuous halo phenomenon is not generated in the photometric region).

Embodiment 3

An image display apparatus and a control method thereof according to Embodiment 3 of the present invention will now be described with reference to the drawings. In Embodiment 1 and Embodiment 2, it is determined whether a change due to the difference of the light emission quantity between the light emitting units is generated in the light from the photometric region, based on the first determination value (ratio of the difference value, which is acquired by subtracting a minimum value from a maximum value of the determined light emission quantity, with respect to the maximum value). In this embodiment, an example of determining whether a change is generated in the photometric region using a method that is different from Embodiment 1 and Embodiment 2 will be described.

The functional configuration of the image display apparatus according to this embodiment is essentially the same as Embodiment 1. The only difference is that the processing by the sensor use determination unit 108 (specifically, the change determination processing) is different from Embodiment 1. Since other processings are the same as Embodiment 1, description thereof is omitted.

Figure 10:
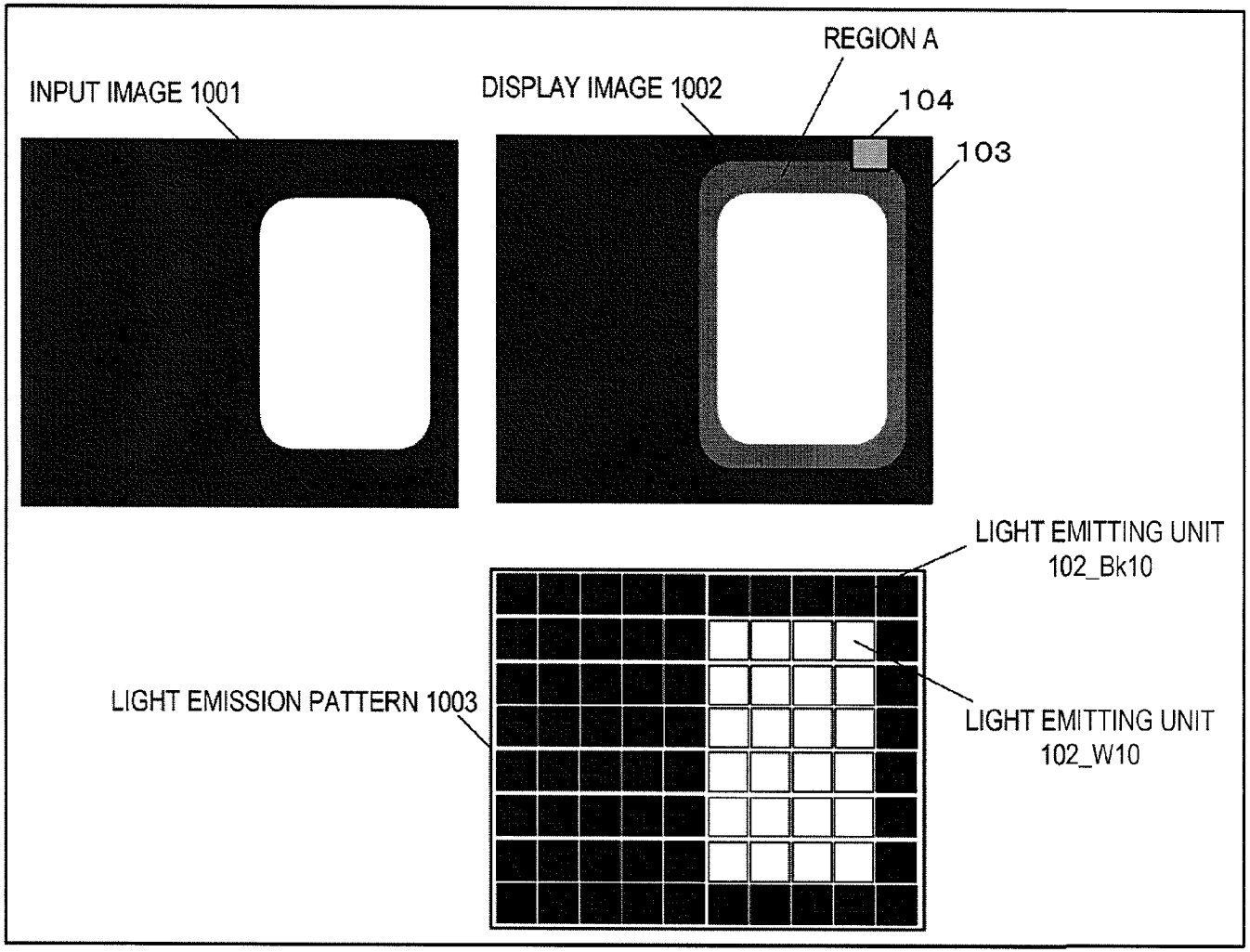
FIG. 10 is an illustration explaining a halo phenomenon according to Embodiment 3.
Figure 11:
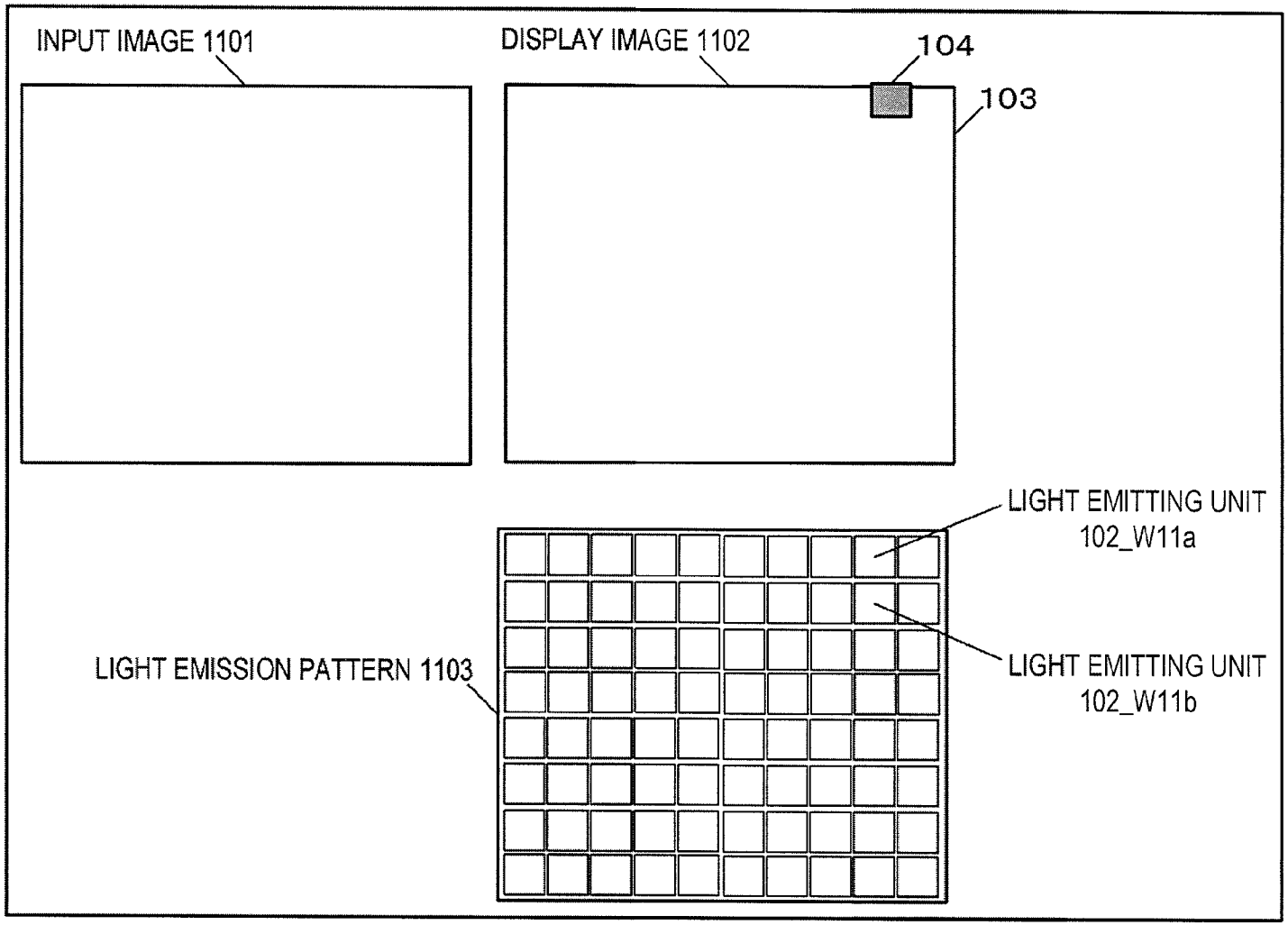
FIG. 11 is an illustration explaining a halo phenomenon according to Embodiment 3.

The generation of a halo phenomenon due to local dimming control will be described with reference to FIG. 10 and FIG. 11. FIG. 10 shows an example when a conspicuous halo phenomenon appears, and FIG. 11 shows an example when a conspicuous halo phenomenon does not appear. The reference numeral 1001 in FIG. 10 and the reference numeral 1101 in FIG. 11 denote an input image (image represented by input image data). The reference numeral 1002 in FIG. 10 and the reference numeral 1102 in FIG. 11 denote a display image (image displayed on screen). The reference numeral 1003 in FIG. 10 and the reference numeral 1103 in FIG. 11 denote a light emission pattern (light emission quantity of each light emitting unit 102) of the backlight 101.

An example of the case when a conspicuous halo phenomenon appears will be described first with reference to FIG. 10.

The input image 1001 is an image where a white object exists against a black background, an APL is low in a divided region that mostly includes the black background region, and an APL is high in a divided region that mostly includes the white object region.

As described in Embodiment 1, the light emission pattern calculation unit 107 performs the processing to allow a light emitting unit 102, corresponding to a divided region of which acquired APL is low, to emit light at a low light emission quantity, and a light emitting unit 102, corresponding to a divided region of which acquired APL is high, to emit light at a high light emission quantity. Therefore as the light emission pattern 1003 in FIG. 10 shows, the light emission pattern calculation unit 107 performs processing to allow a light emitting unit 102_Bk10, corresponding to a divided region which mostly includes the black background region, to emit light at a low light emission quantity, and allow a light emitting unit 102_W10, corresponding to a divided region which mostly includes the white object region, to emit light at a high light emission quantity.

By this processing, contrast of the display image can be enhanced.

However the difference of the light emission quantity between the light emitting unit 102_Bk10 and the light emitting unit 102_W10 (a light emitting unit corresponding to the divided region adjacent under the divided region corresponding to the light emitting unit 102_Bk10) is large. Therefore the light from the light emitting unit 102_W10 leaks into the divided region corresponding to the light emitting unit 102_Bk10, and the halo phenomenon is generated in the region A in the display image 1002. In other words, the light from the region A (brightness and colors of the region A) changes due to the light from the light emitting units corresponding to the peripheral region. In concrete terms, the region A in the black background is displayed brighter than the remainder of the black background region.

Furthermore, in the case of the halo phenomenon generated in the photometric region, as shown in FIG. 10, the optical sensor 104 detects that the light changed by the halo phenomenon (light in a state where black floaters or the like is generated). In other words, if the halo phenomenon is generated in the photometric region, the error in the detected value determined by the optical sensor increases. The use of such a detected value makes it impossible to perform accurate calibration.

An example of the case when a conspicuous halo phenomenon does not appear will be described next with reference to FIG. 11.

The input image 1101 is an image that is entirely white, and an APL is high in each divided region. Therefore as the light emission pattern 1103 in FIG. 11 shows, the light emission pattern calculation unit 107 performs processing to allow each light emitting unit to emit light at a high light emission quantity. As a result, a display image 1102, where brightness within the screen is uniform, is displayed.

In this case, the difference of the light emission quantity between the light emitting units, such as the light emitting unit 102_W11*a* and the light emitting unit 102_W11*b* (a light emitting unit corresponding to the divided region adjacent under the divided region corresponding to the light emitting unit 102_W11*a*) is small. Therefore a conspicuous halo phenomenon does not appear. In the case of FIG. 11, the difference of the light emission quantity between the light emitting units is zero, hence a halo phenomenon is not generated. Needless to say, a halo phenomenon is not generated in the photometric region either. In such a case, the photosensor can acquire a detected value with a small degree of error, and accurate calibration can be performed.

In this way, a conspicuous halo phenomenon tends to be generated when the difference of the light emission quantity between light emitting units corresponding to divided regions which are adjacent to each other is large. As described in Embodiment 1 (FIG. 5), a conspicuous halo phenomenon is sometimes generated even if the difference of light emission quantity between light emitting units, corresponding to divided regions which are distant from each other, is large. However the conspicuous halo phenomenon is less likely to be generated by the light from a light emitting unit corresponding to a distant divided region, than by the light from a light emitting unit corresponding to an adjacent divided region, since the light from a light emitting unit decays as th distance from the light emitting unit increases.

Therefore according to this embodiment, it is determined whether a conspicuous halo phenomenon is generated in the photometric region, based on the difference value between a light emission quantity of a light emitting unit corresponding to a divided region and a light emission quantity of a light emitting unit corresponding to a divided region adjacent to this divided region. In other words, it is determined whether a change due to difference of light emission quantity between the light emitting units is generated in the light from the photometric region, based on the difference value between a light emission quantity of a light emitting unit corresponding to a divided region and a light emission quantity of a light emitting unit corresponding to a divided region adjacent to this divided region. In concrete terms, the sensor use determination unit 108 calculates a difference value between the light emission quantity of a light emitting unit corresponding to a divided region decided (selected) by the determination region decision unit 109 (divided region located in a predetermined range from the photometric region) and the light emission quantity of the light emitting unit corresponding to the divided region adjacent to this divided region. Then the sensor use determination unit 108 compares a second determination value Lum_Diff_2, which is a maximum value of the calculated difference values, with a threshold L_Th_2. In concrete terms, the sensor use determination unit 108 determines whether the second determination value Lum_Diff_2 is the threshold L_Th_2 or less. If the second determination value Lum_Diff_2 is greater than the threshold L_Th_2 the sensor use determination unit 108 determines that detection of light is impossible (light may not be detected). If the second determination value Lum_Diff_2 is the threshold L_Th_2 or less, the sensor use determination unit 108 determines that detection of light is possible (light may be detected), and outputs a flag F1 which notifies this determination result to the optical sensor 104. This is because if the second determination value Lum_Dif_2 is greater than the threshold L_Th_2, a conspicuous halo phenomenon is more likely to be generated in the photometric region, and if the second determination value Lum_Diff_2 is the threshold L_Th_2 or less, a conspicuous halo phenomenon is less likely to be generated in the photometric region.

The rest of the processing is the same as Embodiment 1.

As described above, according to this embodiment, whether a conspicuous halo phenomenon is generated in the photometric region is determined based on the difference of the light emission quantity between light emitting units corresponding to divided regions adjacent to each other. Therefore very accurate calibration can be performed using only the detected values determined by the optical sensor, acquired when it is determined that a change is not generated in the light from the photometric region (a conspicuous halo phenomenon is not generated in the photometric region).

The determination method of this embodiment may be applied to Embodiment 2. In other words, for all the divided regions, the difference value between the light emission quantity of a light emitting unit corresponding to each divided region and a light emission quantity of a light emitting unit corresponding to a divided region adjacent to this divided region is calculated, and the maximum value of the calculated difference values may be used as the second determination value.

The halo phenomenon is generated by the leakage of light of the light emitting unit from a bright region into a dark region. Therefore the maximum value of the difference value, obtained by subtracting the light emission quantity of the light emitting unit corresponding to a divided region including a photometric region from the light emission quantity of the light emitting units corresponding to the divided regions adjacent to the divided region, may be used as the second determination value.

Both the determination processing of this embodiment and the determination processing of Embodiment 1 and Embodiment 2 may be performed. Then it may be determined that a conspicuous halo phenomenon is generated in the photometric region in the case when at least one of the condition that the first determination value is greater than the threshold and the condition that the second determination value is greater than the threshold is satisfied.

Embodiment 4

An image display apparatus and a control method thereof according to Embodiment 4 of the present invention will now be described with reference to the drawings. In Embodiment 1 to Embodiment 3, an example of not using a detected value acquired when it is determined that a change is generated (a conspicuous halo phenomenon is generated in the photometric region) in the change determination processing was described. In this embodiment, an example where the optical sensor detects light regardless the determination result of the change determination processing, and a detected value acquired when it is determined that a change is generated in the change determination processing is not directly but indirectly used, will be described.

Figure 12:
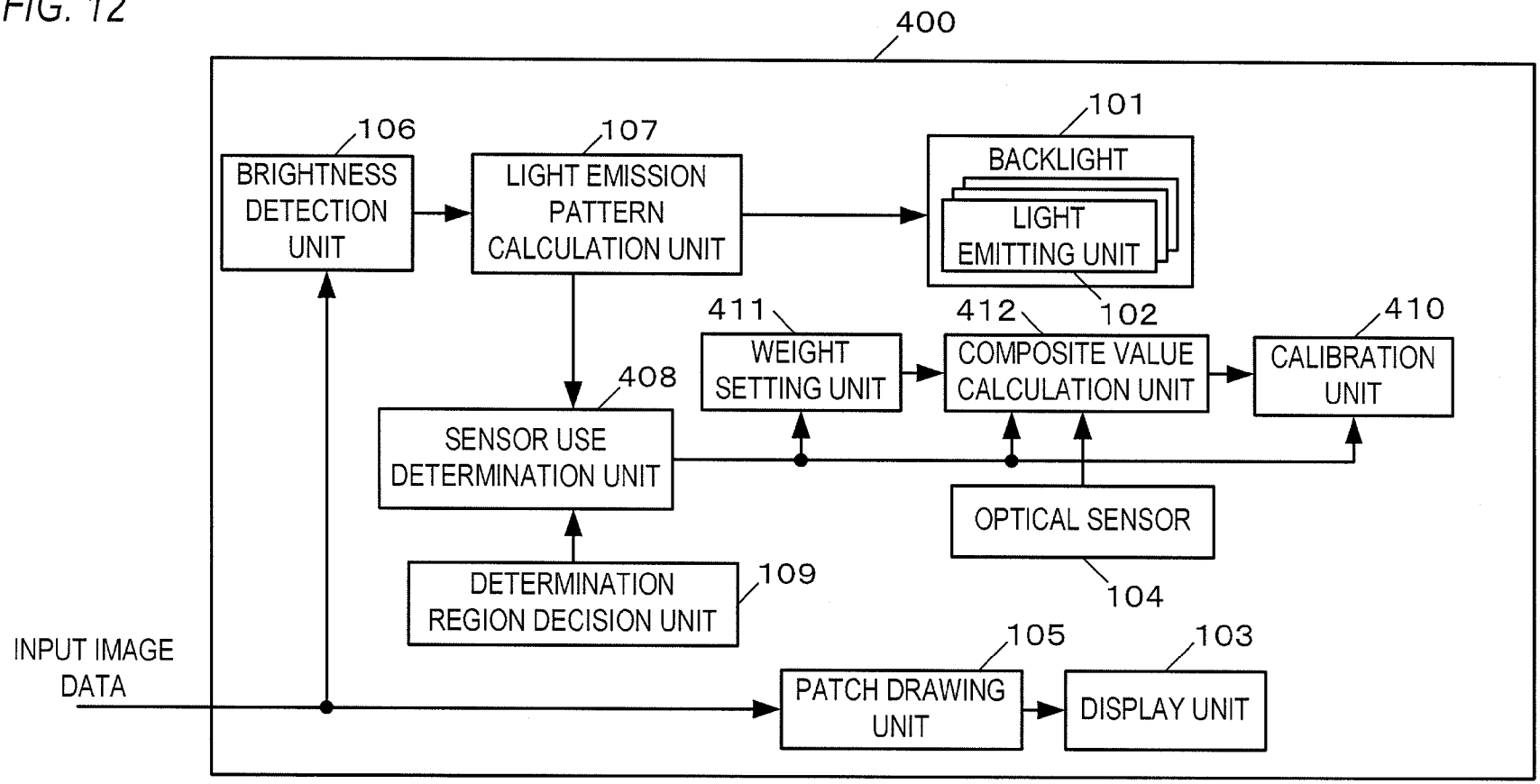
FIG. 12 is a block diagram depicting an example of a functional configuration of an image display apparatus according to Embodiment 4.

FIG. 12 is a block diagram depicting an example of a functional configuration of the image display apparatus 400 according to this embodiment.

As shown in FIG. 12, the image display apparatus 400 has a configuration of the image display apparatus 100 according to Embodiment 1, to which a weight setting unit 411 and a composite value calculation unit 412 are added. A function unit the same as Embodiment 1 is denoted with a same reference symbol, of which description is omitted.

In this embodiment, three calibration images of which brightness is mutually different are displayed simultaneously or sequentially. The optical sensor 104 acquires three detected values corresponding to the three calibration images.

The sensor use determination unit 408 calculates a determination value that indicates how easily a change (the change of light from the photometric region due to the difference of the light emission quantity between light emitting units) is generated, on the basis of the light emission quantity of each light emitting unit, is determined by the light emission pattern calculation unit 107. Then the sensor use determination unit 408 determines whether this change is generated (whether a conspicuous halo phenomenon is generated in the measurement region) by comparing the calculated determination value with the threshold (the change determination processing). In concrete terms, the sensor use determination unit 408 determines whether this change is generated by calculating the first determination value in the same manner as Embodiment 1, and comparing the first determination value with the threshold. The sensor use determination unit 408 outputs the determination value (first determination value) and the determination result of the change determination processing (whether a conspicuous halo phenomenon is generated in the photometric region).

The determination value may be the second determination value.

Figure 13:
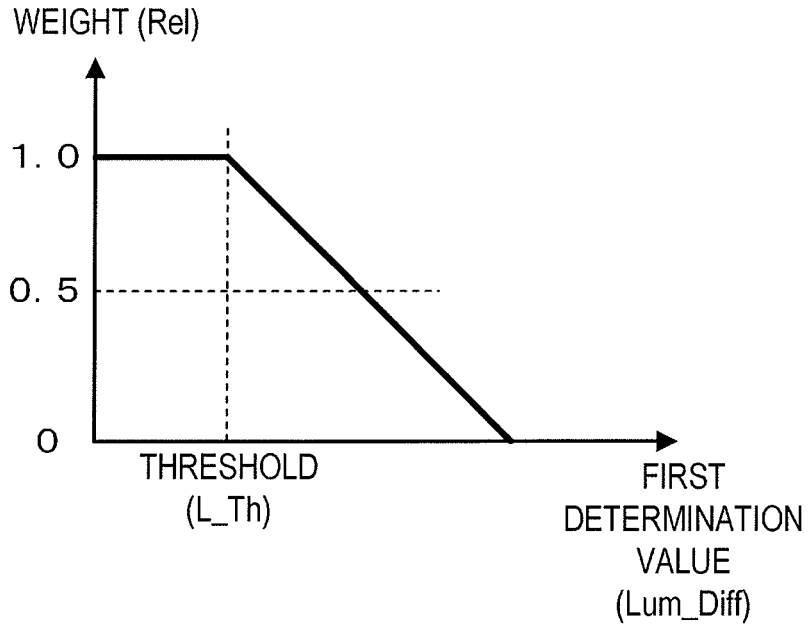
FIG. 13 shows an example of a correspondence between a first determination value and a weight according to Embodiment 4.
Figure 14:
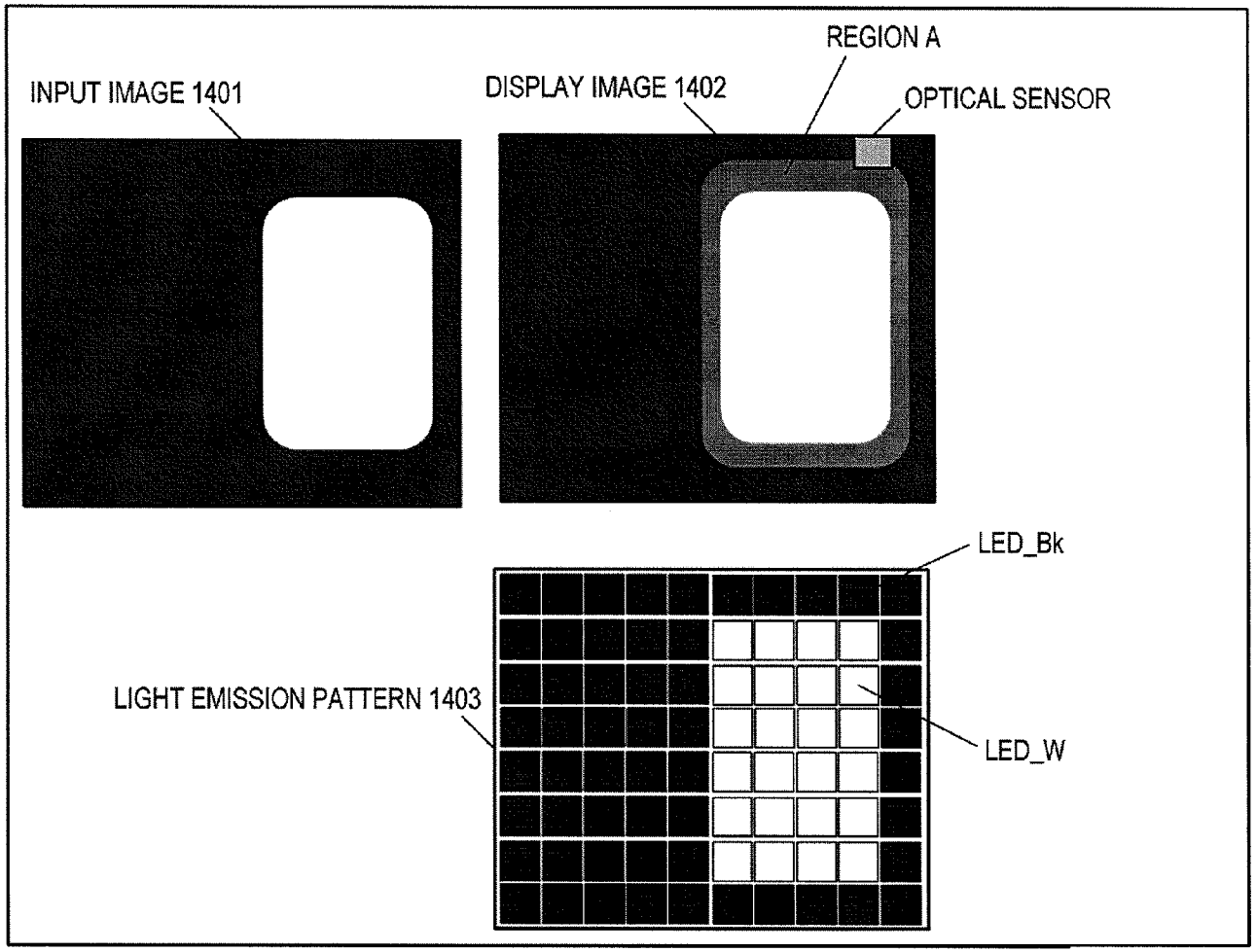
FIG. 14 is an illustration explaining a halo phenomenon.

The weight setting unit 411 sets a weight (weight of a detected value) that is used by the composite value calculation unit 412. In this embodiment, the correspondence of the first determination value Lum_Diff and the weight Rel is predetermined as shown in FIG. 13, and a weight in accordance with the first determination value outputted from the sensor use determination unit 408 is set. In concrete terms, a table (or a function) to show the correspondence has been stored in the weight setting unit 411, and the weight setting unit 411 uses this table and determines and sets a weight in accordance with the first determination value outputted from the sensor use determination unit 408.

The weight may be set regardless the value of the first determination value (determination result of the change determination processing) or may be set in accordance with this value. For example, the weight may be set only when the first determination value that is greater than the threshold L_Th (when it is determined that a change is generated in the change determination processing). In this case, it is sufficient if the correspondence between the first determination value is greater than the threshold, and the weight, has been determined in advance.

The composite value calculation unit 412 calculates the composite value by combining a detected value corresponding to a calibration image having an intermediate brightness, and a difference value between the detected values of the other two calibration images, using the weights that are set by the weight setting unit 411. The composite value is a value in which error due to the halo phenomenon has been reduced. The composite value calculation unit 412 outputs a detected value inputted from the optical sensor 104 to the calibration unit 410 when it is determined that a change is not generated in the change determination processing. The composite value calculation unit 412 also outputs the calculated composite value to the calibration unit 410 when it is determined that a change is generated in the change determination processing.

The composite value may be calculated regardless the determination result of the change determination processing, or may be calculated only when it is determined that a change is generated in the change determination processing.

A weight to match the composite value and the detected value may be determined for the first determination value that is the threshold or less, so that the composite value may be calculated regardless the determination result of the change determination processing. In this case, the composite value calculation unit 412 may output the composite value regardless the determination result of the change determination processing. Thereby the detected value is outputted when it is determined that a change is not generated in the change determination processing, and the composite value is outputted when it is determined that a change is generated in the change determination processing.

The calibration unit 410 performs calibration using the value outputted from the composite value calculation unit 412 (detected value or composite value). In this embodiment, the calibration is performed directly using the detected value from the optical sensor 104 when it is determined that a change is not generated in th change determination processing. On the other hand, the calibration is performed using the composite value calculated by the composite value calculation unit 412 when it is determined that a change is generated in the change determination processing.

The composite value calculation unit 412 may calculate the composite value regardless the determination result of the change determination processing, and output both the composite value and the detected value. Then the calibration unit 410 may select either the composite value or the detected value as a value used for the calibration in accordance with the determination result of the change determination processing.

Whether the composite value or the detected value is used for the calibration may be determined by a function unit other than the calibration unit 410 and the composite value calculation unit 412. For example, the image display apparatus may include a control unit that controls the calibration unit 410, so that calibration is performed using a value (a composite value or a detected value) in accordance with the result of the change determination processing.

A concrete example of how to calculate the composite value will now be described. An example of detecting a brightness value of a gray gradation by the optical sensor 104 will be described. Specifically, an example of detecting the values Lum (n−16), Lum (n) and Lum (n+16) of the calibration images of which gradation values (brightness values) are n−16, n and n+16 will be described. n denotes an 8-bit gradation value.

First using a table (table data) stored in advance, the weight setting unit 411 determines and sets a weight Rel (n) corresponding to the first determination value Lum_Diff outputted from the sensor use determination unit 408. The weight Rel (n) is a weight with respect to the detected value Lum(n).

Then the composite value calculation unit 412 calculates a composite value Cal_Lum (n) from the weight Rel (n) and the detected values Lum (n−16), Lum(n) and Lum (n+16) using the following Expression 2. The composite value Cal_Lum (n) is a value corresponding to a detected value when a calibration image of which gradation value n is displayed, and a value in which error due to the halo phenomenon has been reduced.

$$\text{Cal_Lum}=\text{Lum}(n)\times\text{Rel}(n)+(1.0-\text{Rel}(n))\times(\text{Lum}(n+16)-\text{Lum}(n-16)) \quad \text{(Expression 2)}$$

In the case of the example in FIG. 13, the weight Rel=1 corresponds to the first determination value Lum_Diff that is the threshold L_Th or less. Therefore if the first determination value is the threshold or less (a case when it is determined that a change is not generated in the change determination processing), a value the same as the detected value Lum (n) is acquired as the composite value Cal_Lum (n). When the first determination value is greater than the threshold, a lighter weight is corresponded as the first determination value is greater. Therefore in the case when the first determination value is greater than the threshold (a case when it is determined that a change is generated in the change determination processing), a corrected value of the detected value Lum (n) is acquired as the composite value Cal_Lum (n). In concrete terms, the weight is set such that the weight of Lum (n+16)−Lum (n−16) with respect to Lum (n) increases as the first determination value is greater, and the composite value Cal_Lum (n) is calculated.

As described above, a halo phenomenon appears more conspicuously as the difference of the light emission quantity between light emitting units is greater. Therefore the change amount of the detected value due to the halo phenomenon is greater as the first determination value is greater. Further, as the change amount of the detected value due to the halo phenomenon is greater, a relative value of the reliability of Lum (n+16)−Lum (n−16) with respect to Lum (n) increases. As a consequence, according to this embodiment, a weight is set such that the weight of Lum (n+16)−Lum (n−16) with respect to Lum (n) increases as the first determination value is greater, and the composite value Cal_Lum(n) is calculated. Thereby a composite value with little error than the detected value can be acquired when it is determined that a change is generated in the change determination processing.

As described above, according to this embodiment, the calibration is performed using a composite value with a small degree of error than the detected value when it is determined that a change is generated in the change determination processing. Therefore a more accurate calibration can be performed than the case of directly using the detected value, when it is determined that a change is generated in the change determination processing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-100421, filed on May 10, 2013, and Japanese Patent Application No. 2014-81773, filed on Apr. 11, 2014, which are hereby incorporated by reference herein in their entirety.

What is claimed is:

1. An image display apparatus comprising:

a plurality of light emitting units corresponding to a plurality of regions of a screen;

a display panel configured to display an image based on input image data on the screen by transmitting light from the plurality of light emitting units; and a computer having one or more processors configured to allow each light emitting unit to emit light at light emission quantity based on a characteristic value of the input image data in each region;

acquire, from a sensor, a detected value of light transmitted from the display panel in a predetermined region of the screen; and perform calibration of display characteristics of the display panel using the detected value, wherein the calibration is not performed in a case that a difference between a light emission quantity of a first light emitting unit and a light emission quantity of a second light emitting unit is larger than a threshold, the first light emitting unit and the second light emitting unit being among target light emitting units that are corresponding to target regions located in a predetermined range from the predetermined region.

2. The image display apparatus according to claim 1, wherein the computer is not acquiring the detected value from the sensor in the case that the difference between the light emission quantity of the first light emitting unit and the light emission quantity of the second light emitting unit is larger than the threshold.

3. The image display apparatus according to claim 1, wherein the computer controls the sensor, and in the case that the difference between the light emission quantity of the first light emitting unit and the light emission quantity of the second light emitting unit is larger than the threshold, the computer controls the sensor so that the sensor does not detect the light transmitted from the display panel in the predetermined region.

4. The image display apparatus according to claim 1, wherein the computer performs the calibration in a case that the difference between the light emission quantity of the first light emitting unit and the light emission quantity of the second light emitting unit is not larger than the threshold.

5. The image display apparatus according to claim 1, wherein the first light emitting unit is a target light emitting unit, of which a light emission quantity is smallest, among the target light emitting units, and the second light emitting unit is a target light emitting unit, of which a light emission quantity is largest, among the target light emitting units.

6. The image display apparatus according to claim 1, wherein the second light emitting unit is adjacent to the first light emitting unit.

7. The image display apparatus according to claim 1, wherein the computer determines whether the input image data is a moving image data or a still image data, and the calibration is not performed in a case that it is determined that the input image data is the moving image data.

8. The image display apparatus according to claim 1, wherein the second light emitting unit is a target light emitting unit, of which a difference in the light emission quantity from the first light emitting unit is largest, among the target light emitting units.

9. The image display apparatus according to claim 1, wherein the plurality of regions of the screen are a plurality of divided regions constituting the screen.

10. A control method of an image display apparatus, the image display apparatus including:

a plurality of light emitting units corresponding to a plurality of regions of a screen; and a display panel configured to display an image based on input image data on the screen by transmitting light from the plurality of light emitting units, and the control method of the image display apparatus comprising:

a control step of allowing each light emitting unit to emit light at light emission quantity based on a characteristic value of the input image data in each region;

an acquisition step of acquiring, from a sensor, a detected value of light transmitted from the display panel in a predetermined region of the screen; and a calibration step of performing calibration of display characteristics of the display panel using the detected value, wherein the calibration is not performed in a case that a difference between a light emission quantity of a first light emitting unit and a light emission quantity of a second light emitting unit is larger than a threshold, the first light emitting unit and the second light emitting unit being among target light emitting units that are corresponding to target regions located in a predetermined range from the predetermined region.

* * * * *